US006101358A

United States Patent [19]

Imai et al.

[11] Patent Number: 6,101,358

[45] Date of Patent: Aug. 8, 2000

[54] IMAGE-FORMING METHOD

[75] Inventors: Takashi Imai; Akihiro Iizuka; Yoshifumi Iida; Hiroshi Nakazawa; Masanori Ichimura, all of Minamiashigara, Japan

[73] Assignee: Fuji Xerox Co., Ltd., Tokyo, Japan

[21] Appl. No.: 09/418,826

[22] Filed: Oct. 15, 1999

[30] Foreign Application Priority Data

Dec. 4, 1998 [JP] Japan ..... 10-345166

[51] Int. Cl.[7] ..... G03G 15/09

[52] U.S. Cl. ..... 399/267; 430/122

[58] Field of Search ..... 399/267, 252, 399/272; 430/122, 120, 108, 106.6, 105

[56] References Cited

U.S. PATENT DOCUMENTS

| | | | |
|---|---|---|---|
| 4,640,880 | 2/1987 | Kawanishi et al. | 430/106.6 |
| 4,822,711 | 4/1989 | Itaya et al. | 430/120 |
| 4,916,492 | 4/1990 | Hoshika et al. | 430/122 X |
| 4,933,254 | 6/1990 | Hosoi et al. | 430/122 |
| 5,422,219 | 6/1995 | Anzai et al. | 430/122 |
| 5,438,394 | 8/1995 | Suzuki et al. | 399/267 |
| 5,571,987 | 11/1996 | Goto et al. | 399/276 |

FOREIGN PATENT DOCUMENTS

| | | |
|---|---|---|
| 1-102588 | 4/1989 | Japan . |
| 7-104513 | 4/1995 | Japan . |
| 8-030105 | 2/1996 | Japan . |

*Primary Examiner*—Arthur T. Grimley
*Assistant Examiner*—Sophia S. Chen
*Attorney, Agent, or Firm*—Oliff & Berridge, PLC

[57] ABSTRACT

Provided is an image-forming method including a step of forming a layer of a developer on a surface of a developer support member disposed facing a latent image support member, a developing step of developing an electrostatic latent image on the latent image support member using the layer of the developer formed to obtain a toner image, a transferring step of transferring the toner image onto a transfer material and a fixing step of fixing the transferred toner image, wherein the developer support member has therein a development magnetic pole in which a magnetic force of a main pole is 100 mT or more, said developer having a toner and a carrier which has a volume average particle diameter of 50 $\mu$m or less, and image formation method is conducted at a process speed of 200 mm/sec or more.

In the image-forming method of the invention, high-quality images free from blurring in a half-tone portion adjacent to a solid image can be formed in a high-speed image-forming process using the two-component developer of a small particle diameter without migration of the carrier into the latent image.

18 Claims, No Drawings

IMAGE-FORMING METHOD

FIELD OF THE INVENTION

The present invention relates to an image-forming method using electrophotography.

DESCRIPTION OF THE RELATED ART

In recent years, as digital full color copier or printer using a digital latent image technology has appeared in an image-forming apparatus in which electrophotography is utilized or applied, the image quality has been markedly improved. However, it is difficult to truly reproduce each latent image formed by the digital method with a developer so used to date. Accordingly, it has been required to more reduce the particle diameter of toner particles and a carrier.

Generally, when a particle diameter of a developer is reduced, each latent image can truly be reproduced indeed. However, since a magnetic force of each particle of a carrier is decreased, the carrier migrates into a surface of a photoreceptor, and a defect of an image comes to appear. That is, when the carrier migrating into the photoreceptor is fixed on a transfer material such as paper, it becomes an image noise. Further, unless the carrier is transferred, blanking occurs.

As digitization has advanced, users making various documents have freely contrived to deeply impress readers with purports of documents. For example, documents published in such diverse styles that a character type is changed, an outlined character is used, shadowing is conducted and half-tone dot meshing is applied to a background have been increasingly circulated. However, in high-level decoration with dot meshing in a background of an image, blurring occurs in a half-tone portion adjacent to a solid portion. The blurring in the half-tone portion is a problem inherent in the electrophotography which occurs in both two-component development and single component development.

By the way, a method for obtaining a high-quality image continuously over a long period of time by preventing the embedding of an external additive on a surface of a toner is proposed in JP-A-7-104513. According to this method, when toner particles, fine particles for improvement of a fluidity which are adhered to the surfaces of the toner particles as an external additive, a specific gravity of the carrier, a particle diameter and an addition ratio are appropriately adjusted, a high-quality image is obtained, but it is impossible to improve the blurring which newly occurs in the half-tone portion adjacent to the slid portion as a defect of an image quality by the latest digitization.

Further, when an image is formed at a high process speed in a digital full color copier or printer using a developer of a small particle diameter, there is a problem that a carrier migrates into a photoreceptor to cause an image defect such as image omission. Thus, a satisfactory method for forming a full color copying image of a high quality by a high-speed process has not yet been present.

SUMMARY OF THE INVENTION

Under such circumstances of the related art, the invention has been made. That is, it is an object of the invention to provide an image-forming method in which a high-quality image can be formed over a long period of time in a high-speed image-forming process using a two-component developer of a small particle diameter without migration of a carrier onto a latent image support member. Another object of the invention is to provide an image-forming method in which when an image is formed at a high process speed, a defect of an image quality occurring when dot meshing is applied to a background of an image is prevented, more specifically, an image-forming method in which blurring in dot meshing that occurs in a boundary portion of a background of a thick line image or a solid image (hereinafter referred to as "blurring in a half-tone portion adjacent a solid portion") can be prevented to form a high-quality fine image.

The invention relates to an image-forming method comprising a step of forming a layer of developer on a surface of a developer support member disposed facing a latent image support member, a developing step of developing an electrostatic latent image on the latent image support member using the layer of developer formed to obtain a toner image, a transferring step of transferring the toner image onto a transfer material and a fixing step of fixing the transferred toner image, wherein the developer support member has therein a development magnetic pole in which a magnetic force of a main pole is 100 mT or more, said developer having a toner and a carrier which has a volume average particle diameter of 50 $\mu$m or less, and image formation method is conducted at a process speed of 200 mm/sec or more.

Further, the developer used in the image-forming method of the invention is preferably a two-component developer in which has a toner coverage of the carrier surface is 20% or more. The toner coverage of this developer is calculated by the formula:

$$\text{Coverage } (\%)=(TC/4)\cdot(d_c/d_t)\cdot(\rho c/\rho t)$$

wherein $d_c$ and $d_t$ are volume average particle radii ($\mu$m) of a carrier and a toner, $\rho c$ and $\rho t$ are true densities (g/m$^3$) of a carrier and a toner, and TC is a toner concentration (% by weight) of a toner in a developer.

Further, in the invention, it is preferable to conduct the image formation using a developer of such a toner concentration that the toner coverage of the carrier surface calculated by the formula is within the range of from 20 to 70%.

DETAILED DESCRIPTION OF THE INVENTION

In the invention, it has been found that in order to ensure a good transferability of a toner without migration of a carrier onto a latent image support (photoreceptor) in increasing process speed of forming a copying image and to prevent blurring that occurs in a half-tone portion adjacent to a solid portion, a specific two-component developer containing a carrier of a small particle diameter is used, and a development magnetic pole having a high magnetic force of a main pole is placed in a developer support (developing roll), whereby a good image free from blurring is obtained.

The developer used in the invention is a two-component developer composed of a toner and a carrier. The toner contains a binder resin and a coloring agent, and further a lubricant and an antistatic agent as required. As the binder resin of the toner, known resins used to date as a binder resin of a toner can be used. Examples thereof include polystyrene or a styrene copolymer, a polyester or its copolymer, polyethylene or an ethylene copolymer, an epoxy resin, an acrylate or methacrylate resin or a copolymer thereof, a silicone resin, polypropylene, a wax, a fluororesin, a polyamide resin, a polyvinyl alcohol resin and a polyurethane resin. Especially, polystyrene, its copolymer, a polyester, an acrylate or methacrylate resin and a copolymer thereof can preferably be used.

Further, as the coloring agent, known pigments and organic dyes can be used. Organic pigments and carbon black are preferably used. For example, pigments described in "Saishin Ganryo Binran" (Nippon Ganryo Gijutsu Kyokai) are available. of these, pigments which are good in color formation, safety and light resistance are preferable. Besides, the toner can contain an antistatic agent, a lubricant such as waxes, fine particles and an inorganic powder as required.

The toner used in the invention can be produced through melt kneading, suspension polymerization, solution polymerization, cohesion of fine particles, melt dispersion, phase reversal emulsification, spray drying and microcapsulizing by appropriately mixing the materials.

Further, it is preferable that the toner used in the invention contains an external additive for fluidization. As the external additive, an inorganic powder or polymer beads having a particle diameter of from 5 nm to 10 $\mu$m are used. The inorganic powder may be subjected to hydrophobic treatment with a coupling agent or a resin as required. Examples of the inorganic powder include silica, titania, alumina, magnesia, zirconia and zinc oxide. Examples of the polymer beads include resin particles such as silicone beads, polymethyl methacrylate particles and polyester particles. Any one of these external additives can be used solely or two or more of them can be used in combination. The volume average particle diameter of the toner obtained from these is preferably 10 $\mu$m or less, more preferably 8 $\mu$m or less.

The carrier used in the invention may be either a resin-coated carrier or a magnetic powder dispersion carrier. As a core material of the resin-coated carrier, magnetic powders such as iron powder, ferrite and magnetite are preferably used. With respect to the magnetic force of the magnetic powder, the saturation magnetization in 3,000 Oe is preferably 60 emu/g or more. Further, the electrical resistance of the carrier is preferably at least $10^6$ Ω and at most $10^{12}$ Ω in view of the image quality. Examples of the resin used in the resin-coated layer include a fluororesin, an acrylic resin, a styrene-acryl copolymer, a silicone resin, a polyester and polybutadiene. The resin-coated layer is formed on the carrier core by dissolving the resin in an organic solvent, coating the solution on the surface of the core through dip-coating or spray-coating, and drying or heat-curing the same. An electroconductive powder, an antistatic agent, an inorganic powder and organic fine particles may be added to the coating as required.

The carrier in the invention needs to have such a relatively small particle diameter that a volume average particle diameter is 50 $\mu$m or less, preferably between 10 and 50 $\mu$m, more preferably between 15 and 40 $\mu$m in view of a chargeability.

The developer used in the invention is the two-component developer composed of the toner and the carrier. The toner coverage of the carrier surface is preferably 20% or more, more preferably between 20 and 70%. In a developer having the toner coverage of less than 20%, it is considered that carriers are abruptly contacted excessively with each other in a magnetic brush formed on a developing sleeve to greatly decrease the resistance of the developer, with the result that when a development bias is applied thereto, the carrier itself is developed. On the other hand, in a developer having the toner coverage of more than 70%, it is considered that the contact between the carriers is abruptly reduced in a magnetic brush formed on a developing sleeve to much increase the resistance of the developer, with the result that blurring occurs in a half-tone portion adjacent a solid portion.

The toner concentration (TC) of the developer is preferably between 4 and 12%. More preferably, an electrical resistance of a developer having TC of 8% is between $1\times10^9$ Ω and $1\times10^{14}$ Ω. In this case, a high-quality image is easily obtained. When the electrical resistance of the developer having TC of 8% is less than $1\times10^9$ Ω, it is impossible to prevent migration of the carrier onto the latent image support member. On the other hand, when it is more than $1\times10^{14}$ Ω, blurring occurs in the half-tone portion adjacent to the solid portion.

The resistance of the carrier and the developer was measured as follows. First, a carrier or a developer (550±25 g/m$^2$) was adhered to a developing sleeve of a developing machine used in an image-forming apparatus to form a brush. In this state, it was placed facing an electroconductive pipe having the same diameter as the latent image support member. The developing sleeve and the electroconductive pipe were kept at a distance of t (cm), and a DC voltage of 1,000 V was applied between the developing sleeve and the electroconductive pipe. At this time, a resistance R (Ω) was measured. Then, when the developing sleeve longitudinal length of the brush in contact with the electroconductive pipe was represented by l (cm), the actual contact width thereof in the developing sleeve circumferential direction by L (cm) and the volume resistivity of the developer layer by ρ(Ω·cm) respectively, ρ/L(Ω) calculated from $R=\{t/(l\cdot L)\}$ with t=0.05 cm was defined as an actual resistivity.

In the image-forming apparatus used in the invention, it is required that a developing roll has a built-in development magnetic pole in which a magnetic force of a main pole is 100 mT or more for preventing migration of the carrier onto the latent image support member. It is preferable to use a developing roll with a built-in development magnetic pole in which a magnetic force of a main pole is 120mT or more. Further, as devices used in the other steps, known devices can be employed as required.

In the invention, the image formation method is conducted at a high process speed of 200 mm/sec or more, preferably 220 mm/sec or more using the two-component developer in such an image-forming apparatus.

At this time, the other development conditions are used in combination, making it possible to prevent the migration of the carrier onto the latent image support member more effectively and to suppress the blurring of the half-tone portion adjacent to the solid portion. For example, it is preferable that the photoreceptor and the developing sleeve are approached at a distance which is set between $0.2\times10^{-3}$ m and $0.4\times10^{-3}$ m. When the distance is less than $0.2\times10^{-3}$ m, the image density is unstable. On the other hand, when it is more than $0.4\times10^{-3}$ m, the blurring in the half-tone portion adjacent to the solid image occurs. Further, the amount of the developer adhered to the developing sleeve is preferably between 20 and 50 mg/cm$^2$. When the amount of the developer adhered is less than 20 mg/cm$^2$, no satisfactory image density is obtained. On the other hand, when it exceeds 50 mg/cm$^2$, the blurring in the half-tone portion adjacent to the solid portion is increased. In addition, it is preferable that when the developing sleeve is turned, the circumferential speed thereof is between 1.5 and 2.5 times that of the latent image support member. When the circumferential speed is less than 1.5 times, the migration of the carrier onto the latent image support member cannot be prevented. On the other hand, when it exceeds 2.5 times, the migration of the carrier onto the latent image support member cannot be prevented either, and the blurring in the half-tone portion adjacent to the solid portion tends to occur.

According to the image-forming method of the invention, excellent images can be formed at a high speed of from 30 to 100 sheets per minute in not only monochromic printing but also full color printing of A4-size sheets.

Further, according to the image-forming method of the invention, even when the image formation is conducted at a high process speed using the two-component developer containing the carrier having the small particle diameter and the developer support having the built-in development main pole with a great magnetic force, high-quality images which are free from the blurring in the half-tone portion can be obtained at a high speed without the migration of the carrier into the photoreceptor.

EXAMPLES

The invention is illustrated more specifically by referring to the following Examples. However, the invention is not limited thereto.

Examples 1 to 5

Five parts by weight of a magenta pigment (Carmine 6BC) are added to a linear polyester resin (Mw: approximately 10,000, Tg: 60° C., Tm: 105° C.) composed mainly of bisphenol A, and these are melt-kneaded. The mixture is roughly pulverized and finely pulverized in a usual manner, and the resulting powder is classified to obtain toner particles having a volume average particle diameter of 6.5 $\mu$m. Subsequently, 100 parts by weight of the toner particles are mixed with 1% by weight of silica (R972, supplied by Nippon Aerosil) to obtain an external additive magenta toner having a true specific gravity of 1.2 g/cm$^3$.

Meanwhile, 1.5% by weight of a PMMA resin are coated on a surface of Cu—ferrite (saturation magnetization: 70 emu/g) having a particle diameter of 35 $\mu$m to give a carrier having a volume average particle diameter of 36 $\mu$m, a resistance of $1\times10^{11}$ Ω and a true specific gravity of 4.5 g/cm$^3$. A resistivity of a developer (TC=8%) obtaines by using this carrier was $1\times10^{12}$ Ω.

A printing test of an image to be copied with dot meshing in a background is conducted using the two-component developer containing the toner and the carrier in which the toner coverage is changed within the range of from 18% to 73% as shown in Table 1.

A printing test of 40 sheets per minute is conducted at a process speed of 220 mm/sec using, as an image-forming apparatus, a developing machine (A color 635, supplied by Fuji Xerox) in which a distance between a latent image support member and a developing sleeve is $0.3\times10^{-3}$ m, an amount of a developer adhered to the developing sleeve is 35 mg/cm$^2$, a developing roll with a built-in magnet in which a magnetic force of a development main pole is 120 mT is mounted and circumferential speed of the developing sleeve relative to that of the photoreceptor is 1.75.

The surface of the latent image support member and the resulting printed images after reproduction of 100,000 sheets are visually observed, and evaluated as follows.

G1: Good without the blanking of the image owing to the adhesion of the carrier to the surface of the latent image support member.

G2: The blanking of the image owing to the adhesion of the carrier to the surface of the latent image support member slightly occurs, but it does not impair the image formation.

○: The blurring is not observed in the half-tone portion of the image.

Δ: The blurring is slightly observed therein.

The results are shown in Table 1.

TABLE 1

| | Toner concentration (TC %) | Toner coverage (%) | Blanking owing to migration of a carrier | Blurring |
|---|---|---|---|---|
| Example 1 | 3.5 | 18 | G2 | ○ |
| Example 2 | 4.0 | 21 | G1 | ○ |
| Example 3 | 8.0 | 42 | G1 | ○ |
| Example 4 | 12.0 | 62 | G1 | ○ |
| Example 5 | 14.0 | 73 | G1 | Δ |

According to Table 1, when the two-component developer with the toner coverage of the carrier surface of from 21 to 62% is used, almost no migration of the carrier onto the latent image support member is observed, and excellent images free from blurring in the half-tone portion is obtained.

Example 6

A printing test of 60 sheets per minute is conducted in the same manner as in Example 2 except that the image-forming process speed is changed to 260 mm/sec. Consequently, the migration of the carrier is not observed on the surface of the latent image support member, nor do the blurring in the half-tone portion occur in the resulting image.

Comparative Example 1

A printing test is conducted in the same manner as in Example 2 except that a magnet in which a magnetic force of a development main pole is 90 mT is used in the developing machine instead of the magnet in which the magnetic force of the development main pole is 120 mT. Consequently, the migration of the carrier is notably observed in the developed image on the surface of the latent image support member. Further, the blanking is also notably observed on the resulting image. Almost no blurring occurs in the half-tone portion.

Comparative Example 2

A printing test is conducted in the same manner as in Example 2 except that Cu—Zn ferrite having a volume average particle diameter of 35 $\mu$m is replaced with Cu—Zn ferrite having the volume average particle diameter of 55 $\mu$m as a core material of the carrier for the two-component developer used in Example 2. Consequently, the carrier is not observed in the developed image on the surface of the latent image support member, nor is the blanking observed therein. However, the blurring notably occurs in the half-tone portion of the resulting image.

What is claimed is:

1. An image-forming method comprising the steps of:

forming a layer of a developer on a surface of a developer support member disposed facing a latent image support member;

developing an electrostatic latent image on the latent image support member using the layer of the developer formed to obtain a toner image;

transferring the toner image onto a transfer material; and fixing the transferred toner image, wherein the developer support member has therein a development magnetic pole in which a magnetic force of a main pole is 100 mT or more, said developer having a toner and a carrier which has a volume average particle diameter of 50 $\mu$m or less, an image formation method is conducted at a process speed of 200 mm/sec or more, and an electrical resistance of the developer when a toner concentration of the developer is 8% by weight is at least $10^9$ Ω and at most $10^{12}$ Ω.

2. The image-forming method of claim 1, said fixed toner image is a multicolor image.

3. The image-forming method of claim 2, said multicolor image is a full color image.

4. The image-forming method of claim 1, wherein a toner coverage of the carrier surface in the developer is 20% or more.

5. The image-forming method of claim 4, wherein the toner coverage of the carrier surface in the developer is at least 20% and at most 70%.

6. The image-forming method of claim 1, wherein the volume average particle diameter of the carrier is between 10 and 50 μm.

7. The image-forming method of claim 6, wherein the volume average particle diameter of the carrier is between 15 and 40 μm.

8. The image-forming method of claim 1, wherein the carrier is composed of a core material and a resin.

9. The image-forming method of claim 8, said core material has saturation magnetization at 3,000 Oe of 60 emu/g or more.

10. The image-forming method of claim 1, wherein the carrier has electrical resistance which is at least $10^6$ Ω and at most $10^{12}$ Ω.

11. The image-forming method of claim 1, wherein the magnetic force of the main pole is 120 mT or more.

12. The image-forming method of claim 1, wherein a toner concentration of the developer is between 4 and 12% by weight.

13. The image-forming method of claim 1, wherein the process speed is 220 mm/sec or more.

14. The image-forming method of claim 1, wherein an amount of the developer on the surface of the developer support member is between 20 and 50 mg/cm$^2$.

15. The image-forming method of claim 1, wherein a ratio of circumferential speed of the developer support member to circumferential speed of the latent image support member is between 1.5:1 and 2.5:1.

16. The image-forming method of claim 1, wherein a distance between the developer support member and the latent image support member is between $0.2\times10^{-3}$ and $0.4\times10^{-3}$ m.

17. An image-forming apparatus comprising:

forming means for forming a layer of a developer on a surface of a developer support member disposed facing a latent image support member;

developing means for developing an electrostatic latent image on the latent image support member using the layer of the developer formed to obtain a toner image;

transferring means for transferring the toner image onto a transfer material; and fixing means for fixing the transferred toner image, wherein the developer support member has therein a development magnetic pole in which a magnetic force of a main pole is 100 mT or more, said developer having a toner and a carrier which has volume average particle diameter of 50 μm or less, an image formation method is conducted at a process speed of 200 mm/sec or more, and an electrical resistance of the developer when a toner concentration of the developer is 8% by weight is at least $10^9$ Ω and at most $10^{12}$ Ω.

18. An image-forming method comprising the steps of:

forming a layer of a developer on a surface of a developer support member disposed facing a latent image support member;

developing an electrostatic latent image on the latent image support member using the layer of the developer formed to obtain a toner image;

transferring the toner image onto a transfer material; and fixing the transferred toner image, wherein the developer support member has therein a development magnetic pole in which a magnetic force of a main pole is 100 mT or more, said developer having a toner and a carrier which has a volume average particle diameter of 50 μm or less, an image formation method is conducted at a process speed of 200 mm/sec or more, the carrier comprising a core material having a saturation magnetization at 3,000 Oe of 60 emu/g or more.

* * * * *